United States Patent [19]

Hyland

[11] 4,429,741

[45] Feb. 7, 1984

[54] SELF POWERED DOWNHOLE TOOL ANCHOR

[75] Inventor: Craig R. Hyland, Magna, Utah

[73] Assignee: Christensen, Inc., Salt Lake City, Utah

[21] Appl. No.: 310,571

[22] Filed: Oct. 13, 1981

[51] Int. Cl.[3] ..... E21B 23/04

[52] U.S. Cl. ..... 166/63; 166/117.6; 166/212; 166/382; 89/1 B

[58] Field of Search ..... 166/55.3, 63, 117.6, 166/212, 217, 297; 175/456; 102/322; 89/1 B, 1 C

[56] References Cited

U.S. PATENT DOCUMENTS

| | | | |
|---|---|---|---|
| 2,308,004 | 1/1943 | Hart | 166/63 |
| 2,373,006 | 4/1945 | Baker | 166/63 |
| 2,618,343 | 11/1952 | Conrad | 166/63 |
| 2,701,614 | 2/1955 | Ragan et al. | 166/63 |
| 2,807,325 | 9/1957 | Webb | 166/63 |
| 3,002,559 | 10/1961 | Hanes | 166/63 |
| 3,026,939 | 3/1962 | Sweetman | 166/63 |
| 3,115,935 | 12/1963 | Hooton | 166/212 |
| 3,990,507 | 11/1976 | Vann | 166/297 |
| 4,250,960 | 2/1981 | Chammas | 166/212 |

FOREIGN PATENT DOCUMENTS

| | | | |
|---|---|---|---|
| 460262 | 11/1913 | France | 102/322 |

*Primary Examiner*—William F. Pate, III
*Assistant Examiner*—William P. Neuder
*Attorney, Agent, or Firm*—Walter Fred

[57] ABSTRACT

A self powered downhole tool anchor device (10) pre-attached to a downhole tool (T) and unitarily supported by a drill string (DS) for a single trip into a well bore, actuated by forceful engagement with the bottom or plug (P) in the well bore and attachment to a well bore casing (C). The anchor device comprises an inner mandrel (20) and lower cone (34) containing a piston (30) and fluid (F) for axially displacing an outer mandrel and piston (44) connected thereto by shear screws (46). An upper cone (20) on the outer mandrel is connected by shear pins to a slip housing (50) containing radially expandable slips (38) keyed to the lower cone (34). A self contained power supply (PS) of combustible material (M) is ignited by a firing pin (90) striking a primer igniter (I) and generates gas pressure applied to the piston 30 and fluid (F) to shear pin (46) and axially displace the outer mandrel and piston (44) upper cone (40) slip housing (50) slips (38) and ratchet ring (62) relative to inner mandrel (20) and cone (34). Screws (52) are then sheared off releasing upper cone (40) from slip housing (50) and allowing relative displacement therebetween to radially expand slips (38) into gripping engagement with the well bore casing (C). A mechanical firing mechanism includes a preloaded compressed spring (100) actuated hammer (98) retained against a spring housing (102) and in a cocked firing position by a shear pin (101) extending from an outer housing (96). A trigger (108) engaged by the spring housing (102) has a foot (110) which engages the bottom of or plug (P) in the well bore. Lowering of a predetermined amount of weight of the assembled unit causes pin (101) to shear and release the hammer (98) which strikes and propels the firing pin into the igniter capsule I.

10 Claims, 5 Drawing Figures

SELF POWERED DOWNHOLE TOOL ANCHOR

TECHNICAL DISCLOSURE

The invention relates to a mechanical self powered fluid pressure actuated apparatus for anchoring a preattached downhole tool to a well bore casing in a single trip into the well bore.

BACKGROUND ART

1. Field of Invention

The invention concerns an anchor device to which a downhole tool such as a whipstock and casing bit assembly may be preattached, supported and lowered, together as unit by connection to a drill string, in a single trip for attachment to a well bore casing and various purposes such as side tracking or deviating the bore.

In particular the anchor device is of the type in which a mechanical firing means ignites a self contained cartridge of fluid pressure generating material. The fluid pressure acts against a piston, fluid and piston to shear a pin, displace a tapered mandrel and radially displace slips into gripping engagement with the side wall of the well bore casing or well bore.

2. Description of the Prior Art

Heretofore, downhole tools of various types have been anchored to a well casing after a number of trips into the bore by radially expandable slips actuated by various self contained fluid pressure generating devices. The fluid pressure is usually generated by igniting combustible material of various types including explosives, and chemically reactive ingredients adapted to produce fluid pressure of sufficient magnitude to actuate the device. Various means for igniting and mixing the materials are known including electrically and mechanically fired explosive charges, bullets, and other projectiles.

The Applicant's anchor differs from the prior art in that it allows for preattachment of the downhole tool thereto for a single trip by drill string into the bore for attaching the entire assembly to the casing. Also, a preloaded mechanical firing mechanism includes a trigger foot that forcefully engages the bottom or plug in the well bore and which under the weight of the assembly applied thereto, shears pins and releases a preloaded hammer. The hammer strikes and propels a firing pin into the igniter of a cartridge of combustible material which forms to generate the fluid pressure and radially expand the anchoring slips into gripping contact with the casing.

DISCLOSURE OF THE INVENTION

A self powered fluid pressure actuatable well bore tool anchor device comprises an inner cylindrical mandrel containing fluid and a piston therein. The inner mandrel has radial openings in its sidewall and an end cap adapted for preattachment to the mating lower end of a well bore tool such as a whipstock adapted at its upper opposite end for preattachment preferrably to a drill bit attached to a drill string for simultaneously supporting and lowering the preattached well bore tool and anchor device into a well bore casing. Attached to the lower end of the inner mandrel is a lower externally tapered slip expander cone keyed to and engaging the lower internally tapered portion of a plurality of radially expandable outer toothed slips. An upper outer expander tube and piston extending around and connected by a shear pin to the inner mandrel is provided with a lower externally tapered end mandrel cone engaging and mating with upper internally tapered portions of the inwardly resiliently biased slips.

A slotted slip housing attached by a shear pin to the upper expander tube holds the slips, movable radially within the slots, in predetermined axial and angularly spaced positions.

A radially expandable split rachet ring with internal teeth axially movable with the upper expander tube is provided for cooperating locking engagement with external teeth on the inner mandrel. A self contained source of power comprises a cartridge of combustible material and ignitor adapted to generate fluid pressure is retained within an upper portion of a power supply housing attached to the lower end of the lower expander cone. A mechanical firing means comprising a firing pin, preloaded hammer trigger device are housed within a firing means housing and maintained in a cocked position by one or more shear pins.

A trigger including a foot adapted to rest on the bottom of or a plug in the well bore engages a trigger spring housing in contact with a preloaded spring and the hammer. Downward movement of the assembly relative to the trigger device causes the pin to shear and release the spring loaded hammer which strikes and propels the firing pin into the primer to ignite the combustible material.

The material burns and creates fluid or gas pressure that acts against piston and fluid which acts between the inner mandrel and outer mandrel and piston to shear pins and allow axial movement of the outer mandrel and slips relative to the lower expander cone, and shear another pin which allows upper expander tube and ratchet cone to move downwardly, expand and lock the slips against the casing wall.

BEST MODE OF CARRYING OUT THE INVENTION

Figure 1:
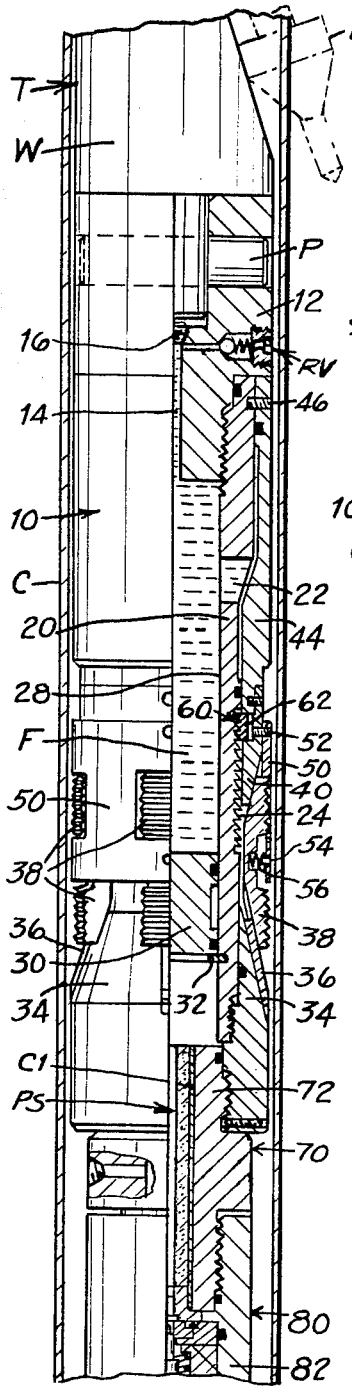
FIG. 1 is a view in elevation and partly in section of the upper and central portion of the anchor device situated within a well bore casing and attached at its upper end to the mating lower end of a whipstock downhole tool for deviating the well bore.
Figure 1A:
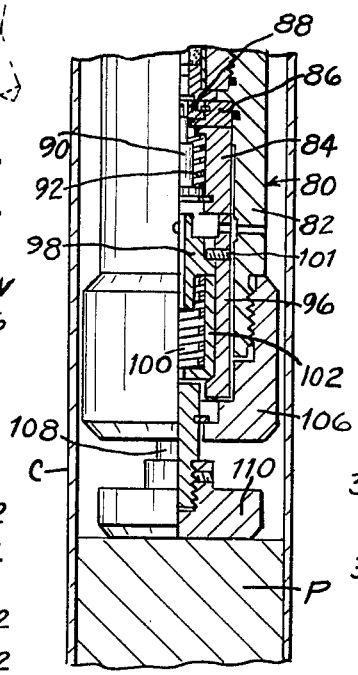
FIG. 1A is a view partly in elevation and partly in section of the remaining lower portion of the anchor device engaging the bottom or plug situated in the well bore casing.
Figure 4:
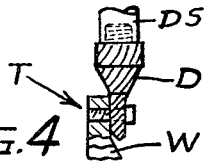
FIG. 4 is a view of the upper portion of the whipstock of FIG. 1 preconnected to a drill bit attached to the drill string for supporting the entire assembly.

Referring to FIGS. 1 and 1A, there is shown a self powered anchor device 10 having an end cap or upper end portion 12 adapted for and connected by a clevis pin P to the inserted mating lower end portion of a downhole tool T. The tool T is preferrably preattached as shown in FIG. 4 by a shear bolt to a drill bit D attached to the end of supporting drill string Ds in a manner similar to that shown in U.S. Pat. No. 3,908,759. However, it could be adapted for direct preattachment to the drill string. Thus, the drill string supports the bit, downhole tool and attached anchor assembly for a single downhole trip and attachment to the well bore casing C.

In this instance the downhole tool T of which an upper portion is shown in FIG. 4 and the lower portion is shown in FIG. 1 is a whipstock W utilized in the well known manner for deviating the well bore by first drilling a window in the casing C with the pilot bit D shown guided by the oriented inclined side of the whipstock W. However, it is obvious that other downhole tools such as perforators, packers, side corers and many other devices may be adapted for attachment to the anchor device of the invention.

The end cap 12 has a central bore 14 plugged by a removable pipe plug 16 in a lower externally threaded end portion thereof sealingly attached to the upper internally threading end of an inner cylindrical or tubular mandrel 20 extending axially to a lower open end thereof. A resiliently biased ball type pressure relief valve RV is connected to the bore 14 in the end cap for venting pressure above a critical level from the device. Inner mandrel 20 has an upper sidewall portion with one or more fluid passages 22 extending laterally therethrough, an intermediate portion with external ratchet engaging teeth 24, a lower externally threaded end portion and an internal chamber 28. A piston 30 including annular seals and grooves therein is retained in the chamber 28, by an annular stop or snap ring 32, for sealing sliding engagement with the mandrel sidewall and seals of the lower open end of the chamber containing a fluid F above the piston. The fluid F is contained in the chamber 28 between the piston 30 and plug 16 in the end cap 12 and extends through the apertures 22 to an annular sealed space around the exterior of the inner mandrel 20.

On, attached or threaded to the lower end of the inner mandrel 20 is an internally threaded and sealed lower tapered slip expander or cone 34. Fixed to the lower cone 34 are equally angularly spaced tapered key ways and keys 36 each adapted for mating, guiding engagement with a lower internally tapered end portion of radially expandable gripping slips 38 with mating internally tapered surfaces, keyways and external gripping teeth or serrations. The keys and keyway prevent relative rotation but allow axial movement between slips and cones. Each slip 38 has upper and lower oppositely tapered internal surfaces resiliently held in mating engagement with similarly oppositely tapered mating external surfaces of axially spaced lower and upper expander cones 34 and 40. The upper expander cone 40 maybe an integral portion of, but is preferrably attached with suitable fasteners or screws shown to the lower end portion of an outer annular tubular piston or cylindrical outer mandrel and piston 44. The outer mandrel 44 has an internal annular piston surface area adjacent the fluid passages 22 and is slideable on, sealingly engaged with and attached to the upper end portion of the inner mandrel 20 by at least one but preferably a plurality of shear screws 46.

A tubular slip housing or sleeve 50 provided with angular spaced windows or openings in its sidewall for initial displacement of and holding the slips 38 in the angularly spaced positions is attached by one or more shear pins or screws 52 to the upper cone 40. The housing 50 extends downwardly to a lower end portion thereof situated adjacent an exterior channel or recess in each slip 38. Angularly spaced pins, studs, or projections 54 attached to the housing 50 extend inwardly into the channels. Resilient means such as compression springs 56 recessed into each of the slips 38 and inserted over the pins 54 are provided between the housing 50 and slips 38 for resiliently maintaining the slips retracted and in mating contact with tapered surfaces of cones 34 and 40.

Between an intermediate toothed portion of the inner mandrel and the upper cone 40 are ratchet means 60 for locking and preventing retracted axial movement of the cones 30 and 40 away from the radially expanded slips 38.

The ratchet means comprises cooperating external ratchet teeth on the intermediate portion of inner mandrel and mating internal ratchet teeth on a radially expandable resilient split ratchet ring or annular pawl 62.

The resilient split ring or pawl 62 is situated within an internal annular groove and between opposing shoulders of the upper cone 40 and the attached outer mandrel and piston 44. Hence, relative axial movement between the outer and inner mandrels 44 and 20 in one direction moves the pawl 62, and causes the cooperating upper tapered sides of the internal ratchet teeth to slide over the external ratchet teeth of the inner mandrel 20. Simultaneously therewith, the ring 62 expands radially sufficiently to disengage and advance its internal ratchet teeth for contraction into locking mating engagement with the straight radial bottom or lower opposite sides of other adjacent external teeth of the inner mandrel 20.

Once contracted, the split annular pawl or ring 62 prevents reverse relative movement between the mandrels, cones and slips 38 and thereby maintains the anchoring engagement between the expanded slips 38 and sidewall of the casing C.

Self contained power supply means or unit 70 is provided comprising a housing 72 threadedly attached and locked to the lower internally threaded end of the lower expander cone 34 on inner mandrel 20. The cartridge housing 72 has, adjacent the lower end of the chamber 28 in the inner mandrel 20, an elongated internal sealed chamber containing a self contained canister PS of ignitable fluid or gas pressure generating material.

Figure 3:
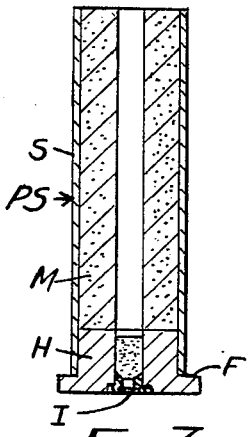
FIG. 3 is a sectional view through the self contained cartridge of fluid pressure generating material.

The canister comprises as shown in FIG. 3 agenerally hollow holder or shell casing S of any suitable metal, plastic, paper or fiber material having an open exit or outlet end thereof situated opposite an integral or separate shouldered or flanged head H fixed to the opposite end of the shell casing S.

An integral annular flange or shoulder F extends radially outwardly from the head H for engagement with the lower opposite end of the housing 72 and adjacent cartridge retainer means in the firing mechanism 80. A central bore in the head H contains a primer or ignitor I of conventional suitable construction in the form of a center fire cartridge or capsule pressed into the central bore. The capsule I contains a small charge of pyrotechnic powder ignitor material for simultaneously igniting the main outer annular charge of fluid pressure generating and propellant material M.

The propellant material M is preferably a type of combustible material that burns at a much slower rate than conventional explosive materials do. A suitable slow burning pressure generating material is preferably a mixture of strontium nitrate, potassium percholrate and poly butadiene oxiamide. A similar but more rapid burning mixture may be used as the primer ignitor material.

Mechanically actuated firing means are provided for striking the ignitor or primer capsule and igniting the charge M. The firing means comprises a preloaded firing mechanism 80 preassembled within an outer firing mechanism body or housing 82 threadedly attached as a unit to the lower externally threaded end of the power supply cartridge housing 72.

Within the upper portion of the outer casing 82 are firing pin means including a firing pin housing 84, and an abutting firing pin guide housing or retaining ring 86 with a central bore into which a firing pin guide 88 is inserted and retained by an internal expandable snap ring.

An upper or forward striker end of a firing pin 90 is slidably and sealably mounted in a central guide way or bore of the guide member 88 and adapted for striking the ignitor capsule I adjacent thereto. The firing pin 90 is normally resiliently biased away from the igniter capsule I and against a stop or retainer ring by resilient means such as a light compression spring 92 extending around an intermediate portion of the firing pin 90 within a central bore of the housing 84. The spring 92 extends axially between an internal shoulder of the housing 84 and an annular shoulder or flange at the opposite end of the firing pin 90 and only applies a light force sufficient to maintain the firing pins in the retracted position shown against the stop against the action of external pressure.

Adjacent to and abutting the lower end of the firing pin housing 84 is a firing pin hammer means including a hammer means or trigger housing 96 in a central bore of which a preloaded trigger or hammer 98 is slidably mounted. The hammer 98 is retained in a cocked position by engagement of a preloaded resilient compression spring 100 therewith and the opposing strength of one or more shear screws or pins 101 projecting through the sidwall of the housing 96 and into obstructing engagement with a side surface or recessed shoulder in the side of the hammer 98. A preloaded or precompressed compression spring 100 is situated within the internal bore of a generally cup shape trigger sleeve and or spring housing or cup 102 mounted within the hammer housing or casing 96.

The spring 100 is compressed between and extends axially from the annular bottom or end of spring housing and or trigger sleeve 102 to a recessed annular shoulder or surface adjacent the opposite lower projecting pilot end of the hammer 98.

The bottom of the spring housing or trigger sleeve 102 is maintained in engagement with an internal annular mating beveled bottom of the hammer housing 96 by the spring 100 while its opposite upper end is adapted for engagement with the hammer 98 adapted to strike and propel the firing pin into the primer igniter capsule I.

A mechanical trigger means is provided and attached to the lower end of the anchor device for applying sufficient axial force against the trigger sleeve and or spring housing 102 and hammer 98 to shear screw 101 and release the spring loaded hammer 98.

The trigger device comprises an end cap 106 threaded to the internally threaded lower end of the firing body or housing 82 of the firing mechanism 80. A trigger plunger or shaft 108, threadably attached to an enlarged trigger foot or head 110, is slideably mounted in and retained by engagement of a snap or retainer ring with an annular shoulder of the cap within a central multiple step bore of the end cap 106. The upper end of trigger shaft 108 is adapted for foreceful engagement with the bottom of trigger sleeve 102 and the foot 110 for engagement with the bottom of the bore hole or a plug P placed into the bore hole.

Figure 2:
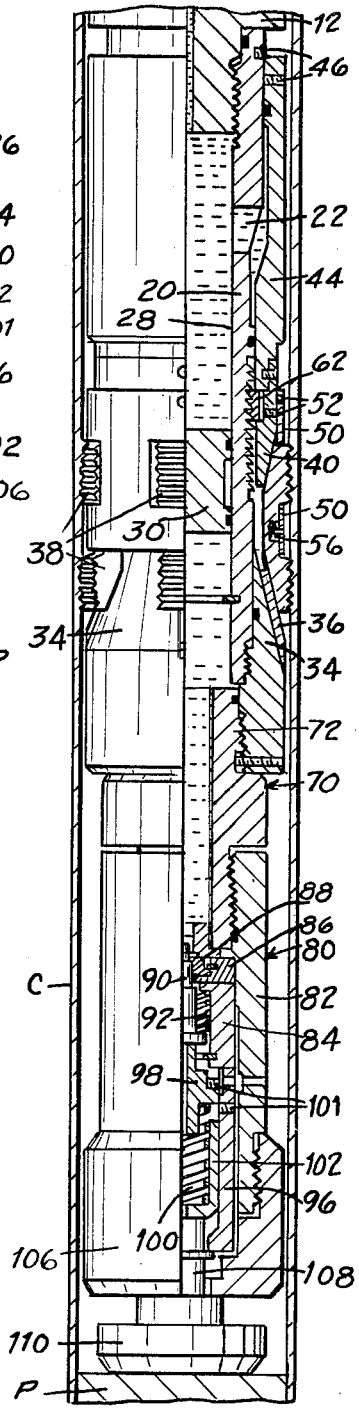
FIG. 2 is a view partly in elevation and partly in section of the anchor device after being actuated and in gripping engagement with the well bore casing.

The actuation and operation of the anchor device can be more clearly understood by correlating the following description with FIG. 1, 1A and FIG. 2 of the drawings and comparing the fired, displaced and anchor position of the components of the actuated device shown in FIG. 2 with the initial preloaded, nonfired and nonanchor position shown in FIGS. 1 and 1A. Operation of the anchor device 10 will be described in combination with the placement of a well bore tool T which, by example only, is a whipstock W usually utilized for deviating the direction of the bore hole at some point.

The conventional whipstock is usually adapted as shown in FIG. 4 at its upper end for preattachment by a shear bolt to the lower pilot end of the drill bit D supportedly connected to a drill string DS and its lower end portion may obviously be, if necessary, modified and adapted to be precoupled to the upper end of the anchor device with a clevis pin P as shown or in any other suitable manner. Once the bottom of the bore hole or top of plug P placed therein has been established below the desired beginning point of bore hole deviation, a drill string with the preattached bit, whipstock and anchor device are lowered into the bore hole casing and supported thereby slightly above or in light partly loaded frictional engagement with the bottom or top of the plug P.

Hence, the entire full load of weight of the assembly of the anchor device IV, whipstock bit and drill string is not lowered upon and supported by the bottom or plug P. The asmuith and orientation of the inclined surface of the whipstock W is checked by known means and if necessary, rotated to face the proper direction.

Once oriented the drill string is relaxed whereby the entire weight of the assemblyis applied to and resisted by the plug P engaged by the trigger foot 110. Hence, the total downward force of the greater weight of the remainder of the assembly relative to an immovable solid column provided by the engaging hammer 98, trigger sleeve 102, trigger plunger 108 and trigger foot 110 all supported by the bottom or plug P causes the hammer housing 96 to move downwardly and shear pin 101.

Upon shearing of the pin 101 the energy stored in the preloaded spring 100 is released and propels the hammer 98 upwardly into engagement with the firing pin 90. The blow delivered by the hammer overcomes the slight resistance of the return spring 92 and propels the firing pin and upper end thereof into the primer igniter capsule I in the power supply cartridge head H.

The mechanical primer or igniter capsule of powder burns creating a flame which ignites the adjoining slower burning pressure generating material or propellant M. Burning of the propellant generates gas or fluid pressure in lower end of chamber C that acts against piston 30 which pressurizes hydraulic fluid F.

Fluid pressure acting through passages 22 and between differential areas of inner mandrel W and internal piston of the outer mandrel and piston 44 shears the screw or scres 46 to release and move the upper and lower cones 34 and 40 relative to each other and expand the slips 38 into permanent gripping engagement with the casing C.

The initial relative downward movement of outer mandrel 44 carries with it, the ratchet lock ring or pawl 62, attached upper cone 40, slip housing 50, and the slips 38 engaged thereby.

Slips 38 move downwardly on lower cone 34 and radially outwardly into firm gripping contact with the interior wall of casing C sufficient to cause sufficient build up of pressure to shear the shear screws 52 between the upper cone 40 and slip housing 50. Release of the upper cone 40 results in further downward movement of the outer mandrel piston 44 and locking pawl 62 and hence radial outward movement of the slips 38.

Until dissipated the fluid pressure acts to move and maintain pressure on the cones 34 and 40 and expand the slips 38 and the locking pawl 62 locks the cones and slips in place against reverse loosening movement. The check valve RV is set to and will exhaust excessive fluid pressure above that necessary to actuate the device and thereby prevent damage thereto.

Thus, the anchoring device and attached downhole tool T or whipstock W is permanently anchored in the desired preoriented direction against axial as well as rotational movement due to the cones contacting and keyed to the anchor slips. Thereafter, the casing drill D and drill string DS is detached from the whipstock in any well known manner such as by applying sufficient weight and force to shear the attaching shear bolt. The casing drill D is then lowered into guiding engagement with the tapered surface of the whipstock to drill through the casing C and eventually change the direction of the bore hole in the known manner. Once a window has been established in the casing, bit D is replaced by any suitable drilling device or assembly to drill the side tracked well bore.

The shear screws or pins are so designed to shear under loads and in the predetermined sequence described.

As many embodiments and modifications of the invention are possible it is to be understood that the invention includes all embodiments, modifications and equivalents thereof falling within the scope of the appended claims.

What is claimed is:

1. A self powered downhole tool anchor device preattached to a downhole tool adapted for attachment to support means for simultaneously lowering them as a unit in a single trip into a well bore and actuated by engagement with and weight thereof applied toward a bottom of or plug in the well bore for attachment to a sidewall inthe well bore comprising:

an inner mandrel having a closed end portionj with coupling means thereon connected to the downhole tool.

a sidewall extending around an internal chamber closed off by the closed end portion and extending axially to an opposite open end of the inner mandrel, at least one fluid passage in the sidewall of the inner mandrel.

ratchet teeth on an intermediate external side portion of the sidewall of the inner mandrel, and a lower expander cone tapering outwardly and downwardly from and extending around a lower end portion of the inner mandrel;

an outer mandrel and piston extending around and adapted for sliding sealing engagement with an external surface of the inner mandrel and initially connected by shearable means to the inner mandrel and including an internal piston surface area extending around the inner mandrel adjacent the fluid passage, and an upper cone situated adjacent a lower end portion of the outer mandrel and tapering inwardly toward and extending around the sidewall of the inner mandrel;

a plurality of gripping slips including upper and lower internal surfaces angularly spaced around the cones and fixed against rotation relative to at least one of the cones and adapted for engagement and radial displacement by the cones into gripping engagement with the sidewall in the well bore;

releasable slip housing means extending around and attached by shearable means to the upper cone portion of the outer mandrel and piston for displacing and maintaining the slips angularly spaced about for contact with the upper and lower cones;

ratchet means including ratchet teeth adapted for locking engagement in one direction with external teeth of the inner mandrel and displaceable in one axial direction by movement of the outer mandrel and piston relative to the inner mandrel for preventing opposite reverse movement and disengagement of the cones from the slips and slips from the sidewall;

power supply means supported adjacent the lower open end of the inner mandrel including combustible material adapted to be ignited by a primer igniter and supply a sufficient source of fluid pressure in the internal chamber for releasing and displacing the outer mandrel and piston, upper cone and slips relative to the inner mandrel and lower cone and force the gripping slips radially outwardly into gripping engagement with the sidewall in the well bore comprising a power supply housing attached to the lower cone portion of the inner mandrel adjacent the open end including an internal cartridge chamber extending between opposite ends of the housing, a cartridge of ignitable combustible propellant material situated in the internal cartridge chamber with one end adjacent the open end of the inner mandrel including a head at an opposite end of the cartridge, and a central primer igniter capsule inserted into a central bore in the head for impaction and ignition by and upon release of preloaded firing means;

preloaded mechanical firing means supported adjacent to the power supply means for striking the primer igniter and igniting the combustible material including an outer firing means housing attached to one end portion of the power supply housing, firing pin means including a movable firing pin situated within the firing means housing and adjacent the head for striking the primer igniter capsule, and releasable preloaded hammer means situated within the firing means housing and adjacent the firing pin means for impacting and propelling the firing pin into the primer igniter capsule; and mechanical trigger means adjacent to the firing means and adapted for engaging a bottom or plug in the bore hole and to release the preloaded firing means when a sufficient predetermined amount of weight of the anchor device and support means is released and applied to the trigger means supported by the bottom or plug.

2. A self powered downhole tool anchor device according to claim 1 further comprising:

a piston mounted in the internal chamber adjacent the open end for sliding sealing engagement with the sidewall of the inner mandrel; and fluid contained within the internal chamber between the piston and closed end of the inner mandrel adapted to be pressurized by movement of the piston toward the closed end and to force the fluid under pressure through the fluid passage in the sidewall to act against and release the outer mandrel and piston.

3. A self powered downhole tool anchor device according to claim 1 further comprising:

resilient means between the slip housing means and the slips for initially maintaining the slips retracted into engagement with the cones; and key means between the lower cone and slips for preventing rotational movement and allowing relative axial movement between the cones and slips.

4. A self powered downhole tool anchor device according to claim 1 wherein the power supply means comprises:

a self contained cartridge of the ignitable combustible proppellant material in the internal cartridge chamber including an outer shell casing open at one end adjacent the open end of the inner mandrel, a flanged head, including an annular shoulder attached to an opposite end of the shell casing and retained against an opposite end of the power supply housing by the preloaded firing means, the central primer igniter capsule inserted into the central bore in the head for impaction and ignition by and upon release of the preloaded firing means, and an annular layer of the combustible propellant material situated within the outer shell casing and extending substantially to the primer ignitor capsule for ignition thereby.

5. A self powered downhole tool anchor device according to claim 1 wherein the firing pin means comprises:

a firing pin guide including a central guide way bore for guiding engagement with a portion of the firing pin, situated in the outer firing means housing and adjacent the head of the cartridge;

a firing pin housing adjacent the firing pin guide and extending around an opposite end portion of the firing pin; and resilient means in the housing and adjacent the firing pin for initially maintaining the firing pin in a retracted position away from the primer igniter capsule and which is easily overcome by an impacting force applied, by release of the preloaded hammer means, to the firing pin.

6. A self powered downhole tool anchor device according to claim 5 wherein the preloaded hammer means comprises:

a hammer means housing within the outer firing means housing and adjacents the firing pin housing;

a preloaded hammer slideably mounted in and maintained in a preloaded firing position in the hammer means housing by obstructing engagement of the hammer with shearable means extending radially from the hammer means housing;

a spring housing slideably mounted in the hammer means housing and extending axially from an open end thereof adjacent to and for contacting the preloaded hammer, to and opposite bottom end adjacent an engageable end of the trigger means; and preloaded resilient means compressed sufficiently between the bottom of the spring housing and the preloaded hammer which upon being released, exerts the necessary force to propel the hammer against the firing pin and firing pin into the primer igniter capsule and ignite the combustible material.

7. A self powered downhole tool, anchor device according to claim 1 wherein the trigger means comprises:

an end cap attached to an opposite end of the firing means housing, a plunger slideable and retained in the end cap having an end portion adapted for engaging and releasing the preloaded hammer means; and a foot at an opposite end of the plunger for engaging the bottom or plug in the bore hole.

8. A self powered downhole tool anchor device according to claim 1 further comprising:

a pressure relief valve for releasing excessive fluid pressure generated by the combustible material, from the internal chamber.

9. A self powered downhole tool anchor device according to claim 1 wherein the downhole tool comprises:

a whipstock having a lower end portion attached to the coupling means at the closed end portion of the inner mandrel, an upper end portion opposite the lower end portion, and an inclined side extending between the upper and lower end portions; and a drill bit attached by shearable means to the upper end portion of the whipstock and adapted for attachment to support means for simultaneously lowering the anchor device, attached whipstock and drill bit into the well bore as a unit and actuating engagment with the bottomor plug.

10. A self powered downhole tool anchor device preattached to a downhole tool adapted for attachment to support means for lowering them as a unit in a single trip into a well bore and actuated by engagement with and weight thereof applied toward a fixed bottom of or plug in the well bore for attachment to a side wall in the well bore comprising:

an inner mandrel including a closed upper end portion with a coupling means thereon connected to the downhole tool, a sidewall extending around an internal chamber from the closed upper end portion to an opposite open end, external ratchet teeth on an external portion of the sidewall, a radial passage extending through the side wall, and a cone portion extending around a portion of the side wall;

an outer mandrel and piston extending around, shearably connected to and adapted upon release for slideable sealing engagement with the inner mandrel and having an outer sidewall including an internal piston portion extending around the inner mandrel adjacent the radial passage in the sidewall, a cone portion movable with the outer mandrel relative to the inner mandrel and cone axially spaced therefrom, one way ratchet means including internal ratchet teeth in mating engagement with the external ratchet teeth on the inner mandrel and movable in one direction relative to the inner mandrel;

a plurality of slips angularly spaced around and non-rotatably retained adjacent the axially spaced cones for radial displacement thereby;

power supply means including ignitable combustible propellant material adjacent the open end of the internal chamber and inner mandrel adapted for generating fluid pressure in the internal chamber sufficient to pass through the radial passage and act upon the internal piston to release and displace the outer mandrel, cone and ratchet means relative to the inner mandrel, cone, and external ratchetteeth; preloaded mechanical firing means adjacent the power supply means adapted upon release to activate the power supply means and generate fluid pressure;

trigger means adjacent the firing means and adapted for engaging a fixed bottom or plug in the well bore and which upon lowering of the anchor device and support means, causes a greater portion and weight thereof to be displaced relative to the trigger means and release the preloaded firing means to actuate the anchor device and a downhole tool comprising a whipstock having a lower end portion attached to the coupling means at the closed upper end portion of the inner mandrel, an upper end portion opposite the lower end portion, and an inclined side extending between the upper and lower end portions; and a drill bit attached by shearable means to the upper end portion of the whipstock and adapted for attachment to the support means for simultaneously lowering the anchor device, attached whipstock and drill bit into the well bore as a unit and actuating engagement with the bottom or plug.

* * * * *